US005350124A

United States Patent [19]

Lohnherr et al.

[11] Patent Number: 5,350,124

[45] Date of Patent: Sep. 27, 1994

[54] ROLL MILL

[75] Inventors: Ludger Lohnherr, Oelde; Herbert Pingel, Wadersloh; Ludger Kimmeyer, Beckum; Hans-Dieter Baldus, Ahlen, all of Fed. Rep. of Germany

[73] Assignee: Krupp Polysius AG, Fed. Rep. of Germany

[21] Appl. No.: 21,886

[22] Filed: Feb. 24, 1993

[30] Foreign Application Priority Data

Mar. 24, 1992 [DE] Fed. Rep. of Germany ..... 4209459

[51] Int. Cl.[5] ..... B02C 19/00

[52] U.S. Cl. ..... 241/119; 241/121

[58] Field of Search ..... 241/117, 119, 121

[56] References Cited

U.S. PATENT DOCUMENTS 4,432,500 2/1984 Brundiek et al. ..... 241/121 X
4,828,189 5/1989 Schonbach ..... 241/121
4,909,450 3/1990 Henne et al. ..... 241/121 X

FOREIGN PATENT DOCUMENTS 1250724 9/1967 Fed. Rep. of Germany .
1613161 12/1990 U.S.S.R. ..... 241/117

*Primary Examiner*—Mark Rosenbaum
*Assistant Examiner*—Frances Han
*Attorney, Agent, or Firm*—Learman & McCulloch

[57] ABSTRACT

The invention relates to a roll mill having at least one pair of grinding rollers bearing against a substantially horizontal surface of a grinding table which is rotatable about a vertical axis. The rollers are mounted at one end of a roller support the opposite end of which is guided by guide lugs slidable vertically in guides and linked to the roller support by a tension rod. In order to achieve particularly smooth running of the grinding rollers on the grinding surface, the guides and the guide lugs lie approximately at the level of the grinding surface.

10 Claims, 2 Drawing Sheets

ROLL MILL

The invention relates to a roll mill having a pair of rollers rotatably bearing on a substantially horizontal grinding table that is rotatable about a vertical axis.

BACKGROUND OF THE INVENTION

Roll mills, particularly so-called spring-loaded roller mills, of the type to which the invention relates are well known in the art. These roll mills are used for the comminution of different granular or lumpy materials, such as for example cement materials, ores, coal or the like. One embodiment of these roller mills is known for example from DE-B-12 50 724. In this case the two rollers of a pair of rollers are held so as to be freely rotatable one on each side of a roller support, and in the case of a floating mounting they are reciprocally supported on a roller shaft. The two ends of each roller support project outwards over the periphery of the grinding table and at approximately the height of the grinding roller shaft they are vertically guided via outer guide pins or bolts in housing guides, linkage points for the upper ends of the tension rods being constructed above these guides. One advantage of these known roll mills with pairs of grinding rollers is that each grinding roller of a pair can be adapted in its peripheral speed to that of the appertaining (outer or inner) region of the grinding surface or track, so that the wear on the periphery of the grinding rollers can be kept comparatively low.

In the practical comminuting operation of these known roll mill constructions, on the grinding surface the movement of the material for grinding and the resulting centrifugal forces give rise to radial forces which, through the friction which occurs, attempt to tip the grinding rollers about the guide pins of the roller support, i.e. tipping moments which act on the appertaining pair of grinding rollers are produced about the vertical guides of each roller support. With this friction which occurs particularly between the material for grinding and the grinding rollers, the coefficient of friction thereof alters according to the different conditions of the material for grinding (grain sizes, moistness of the material, density of the material bed, thickness of the material bed, etc.), as a result of which different tipping moments can occur constantly which lead to an additional constant movement in the bed of material for grinding and thus disrupt the comminuting operation.

The object of the invention, therefore, is to improve a roll mill of the type referred to in such a way that with a relatively simple construction undesirable moments of rotation or of tipping in the region of each pair of grinding rollers and of each appertaining roller support are reliably avoided and particularly smooth running of the roll mill is ensured.

SUMMARY OF THE INVENTION

In a roll mill according to the invention at least the housing guides and the guide lugs guided therein lie at the ends of each roller support approximately at the height of the horizontal plane of the grinding track. Furthermore, it is regarded as particularly advantageous if the linkage points of the upper ends of the tension rods lie on the upper ends of the roller supports, also approximately at the height of the horizontal plane of the grinding surface and adjacent to the guide lugs or if these linkage points lie in a practicable manner below the horizontal plane of the grinding surface.

As the tests on which the invention is based have confirmed, a neutral equilibrium can be achieved on each roller support with the appertaining pair of grinding rollers by the aforementioned positioning at least of the guides for the ends of the roller supports approximately at the height of the horizontal plane of the grinding surface. In this way disruptive rotary or tipping moments resulting from the radial forces of the grinding process in the plane of the grinding surface of the known mill constructions are reliably and simply avoided in the region of the guide lugs of each roller support. According to the invention, this neutral equilibrium can be achieved by the arrangement of the guides approximately in the plane of the grinding track and also by additional arrangement of the linkage points of the upper ends of the tension rods on the outer ends of the roller supports in this plane of the grinding surface.

If, on the other hand, only the housing guides and the guide lugs guided therein of each roller support lie approximately at the height of the plane of the grinding surface, whereas the linkage points of the upper ends of the tension rods are provided on the outer ends of the roller supports below the horizontal plane of the grinding surface and below the corresponding guide lugs, then a stable equilibrium is produced for each roller support together with the pair of grinding rollers about its guide lugs.

In one embodiment (neutral equilibrium) and in another embodiment (stable equilibrium) disruptive rotary or tipping moments on the roller support and thus on the appertaining pair of grinding rollers are avoided so that particularly smooth running of the grinding rollers or of the entire roll mill can be ensured.

Since in this construction according to the invention the pairs of grinding rollers during their grinding work can roll comparatively smoothly on the grinding surface or on the material bed located thereon, any radial vibratory movements between the grinding rollers and the material for grinding are reduced to a minimum, as a result of which the composition of the material for grinding is stabilised and thus the effectiveness of the comminution work can be increased. As tests have confirmed, this extremely favourable grinding work also leads to a saving of energy for operating this roll mill according to the invention.

THE DRAWINGS

The invention will be explained below with the aid of the drawings. In these drawings, which have been kept largely schematic, FIG. 1 shows a partial vertical sectional view of one half of the roll mill according to the invention;

THE DISCLOSED EMBODIMENTS

A first embodiment of this roll mill according to the invention will be described first of all with the aid of FIGS. 1 and 2. Before the individual parts of this roll mill are dealt with in detail, it should be stressed that only the parts which are necessary for explanation of the essential features of the invention are illustrated in FIGS. 1 and 2, i.e. only one half—the left-hand half—is shown in a greatly simplified schematic vertical section in FIG. 1, whilst in the horizontal sectional view of FIG. 2 only approximately one quarter is shown, since the other half or quarters respectively can be constructed approximately in mirror image to the illustrated partial sections.

Figure 1:
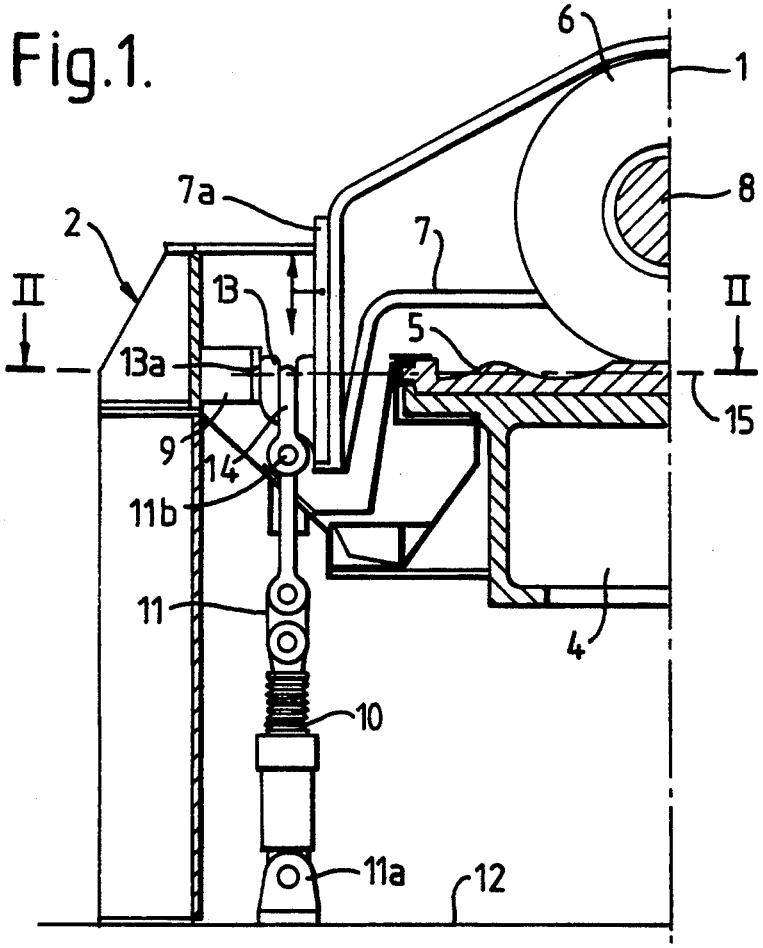
Figure 2:
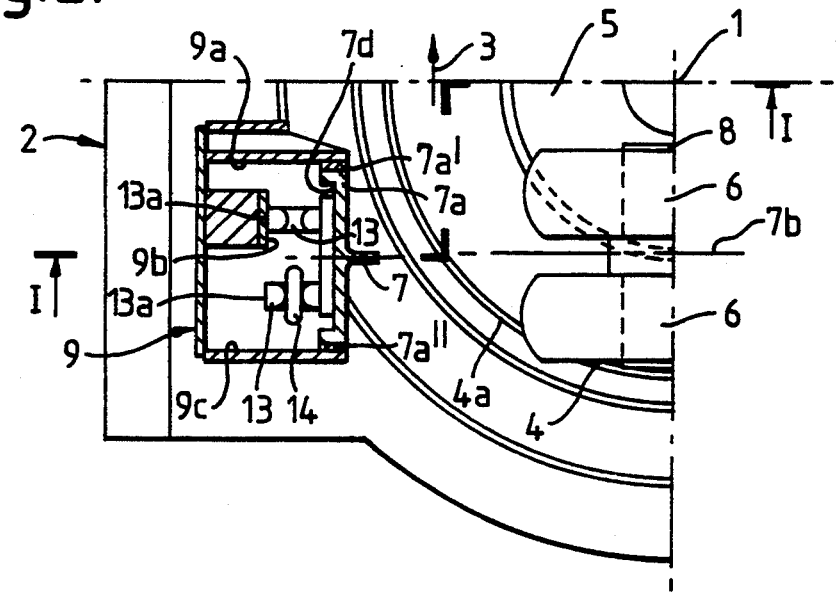
FIG. 2 shows partial horizontal sectional view, approximately along the line II—II in FIG. 1.

The roll mill according to FIGS. 1 and 2 can generally be constructed in the manner of a spring-loaded roller mill with a vertical mill axis 1. This roll mill can contain a conventional frame-like mill housing 2. This roll mill further comprises

- a conventional grinding table 4 which is driven so as to be rotatable about the vertical mill axis 1—for example in the direction of the arrow 3—and which has on its upper face a grinding surface or track 5 which is of circular construction and is aligned substantially horizontally,
- at least one pair of grinding rollers 6 which roll on the grinding surface 5, preferably at least two such pairs of grinding rollers 6 uniformly distributed over the surface of the grinding surface 5,
- for each pair of grinding rollers 6 a roller support 7 which extends above the grinding track and transversely with respect thereto and on which a pair of grinding rollers 6 is mounted so as to be freely rotatable about an approximately horizontal roller axis 8 and substantially stationary and which has guide lugs on its two outer ends 7*a* which project over the periphery of the grinding table or the peripheral edge 4*a* thereof, the guide lugs being guided vertically and radially in housing guides 9, so that a certain tipping movement should also be possible about the approximately horizontal longitudinal central axis 7*b* of the roller support 7,
- as well as several tension rods 11 which are distributed over the periphery of the mill housing 2 and provided with suitable tension spring arrangements (preferably tension cylinders) 10, the lower ends 11*a* of these tension rods being stationary, for example on the bedplate of the mill 12, and their upper ends 11*b* each being linked or coupled to a corresponding outer end, e.g. 7*a*, of the roller supports.

As can be seen in the drawings, each linkage point between an upper end 11*b* of a tension rod and an outer end 7*a* of a roller support can be formed, on the one hand, by a link hook 13 which is attached to one end 7*a* of the roller support and projects axially outwards and, on the other hand, by a shackle 14 which is articulated on the upper end 11*b* of a tension rod, this shackle 14 being hooked from outside and above into the appertaining link hook 13.

In this first embodiment according to FIGS. 1 and 2, the aforementioned guide lugs on each outer end 7*a* of a roller support are each formed by the outer surface 13*a* of the corresponding link hook 13, which surface is vertically aligned and points axially outwards—with respect to the roller support 7—and by the two vertical outer side surfaces 7*a'* and 7*a''* of this roller support end 7*a*. To match these guide lugs each housing guide 9 has—as can best be seen from FIG. 2—three vertically aligned guide surfaces 9*a*, 9*b* and 9*c* which are at approximately right angles to one another in such a way that in horizontal section the shape of a U is formed which is open towards the grinding table. In this way a reliable vertical and radial or axial guide for the roller support 7 or the pair of grinding rollers 6 supported thereon is produced with respect to the grinding surface 5.

In this roll mill it is of particular importance that at least the housing guides 9 and the guide lugs (13*a*, 7*a'*, 7*a''*) guided therein lie on the outer ends 7*a* of the roller supports approximately at the height of the horizontal plane 15 of the grinding surface (in which case this horizontal plane 15 of the grinding surface is formed, in the case of a completely flat grinding surface 5, by its upper face or, in the case of a grinding surface 5 in the shape of an annular trough—as illustrated—by an average horizontal plane). In this case it should of course be borne in mind that during the grinding or comminuting work, i.e. during the action of the grinding rollers 6 on a material bed located on the grinding surface 5, the guide lugs 13*a*, 7*a'*, 7*a''* also carry out certain up and down movements within the housing guides 9 without these guide lugs being able to move significantly in their general vertical position out of the horizontal plane 15 of the grinding surface.

In this first embodiment (FIGS. 1 and 2) it is further provided that the linkage points which are produced by the co-operation of the link hooks 13 and the shackles 14 also lie approximately at the height of the horizontal plane 15 of the grinding surface and thus adjacent to the guide lugs on the outer ends 7*a* of the roller supports. Thus the guide for the outer ends 7*a* of the tension rods and the linkage points for the upper ends 11*b* of the tension rods on the outer ends 7*a* of the roller supports are placed approximately in the horizontal plane 15 of the grinding surface, so that a neutral equilibrium is produced for the roller supports 7 and the pairs of grinding rollers 6.

As can be seen further in FIG. 2, the two grinding rollers 6 of a pair of grinding rollers are arranged symmetrically on opposite long sides of the appertaining roller support 7 or on opposite sides of its horizontal longitudinal central axis 7*b*. In this case an end surface 7*d* which points axially outwards is constructed on each outer end 7*a* of a roller support, and a link hook 13 provided with an outer vertical guide surface 13*a* is attached to this end surface 7*d* symmetrically on either side of the horizontal longitudinal central axis 7*b* of the roller support. Of these two link hooks 13—in the illustrated example—one is used for coupling to the shackle 14, whilst of the second link hook 13 only the outer vertical guide surface 13*a* thereof is slidably guided and supported on the guide surface 9*b* of the housing guide 9 facing it for vertical guiding (for corresponding guiding of the end 7*a* of the roller support). This construction and arrangement of two link hooks 13 on each outer end 7*a* of a roller support offers the advantage that each appertaining upper end 11*b* of a tension rod can be hooked—with the aid of the shackle 14—into that a selected one of the two link hooks 13 which offers the guarantee of the most favourable (most equalised) tensile load for this roller support end. For fine correction of the differing wear between the inner and the outer grinding rollers of each pair of grinding rollers 6, the plate bearing the link hook 13 can also be moved on the end surface 7*d* transversely with respect to the roller support axis 7*b* (cf. FIG. 2) (for example by a corresponding screw connection).

Figure 3:
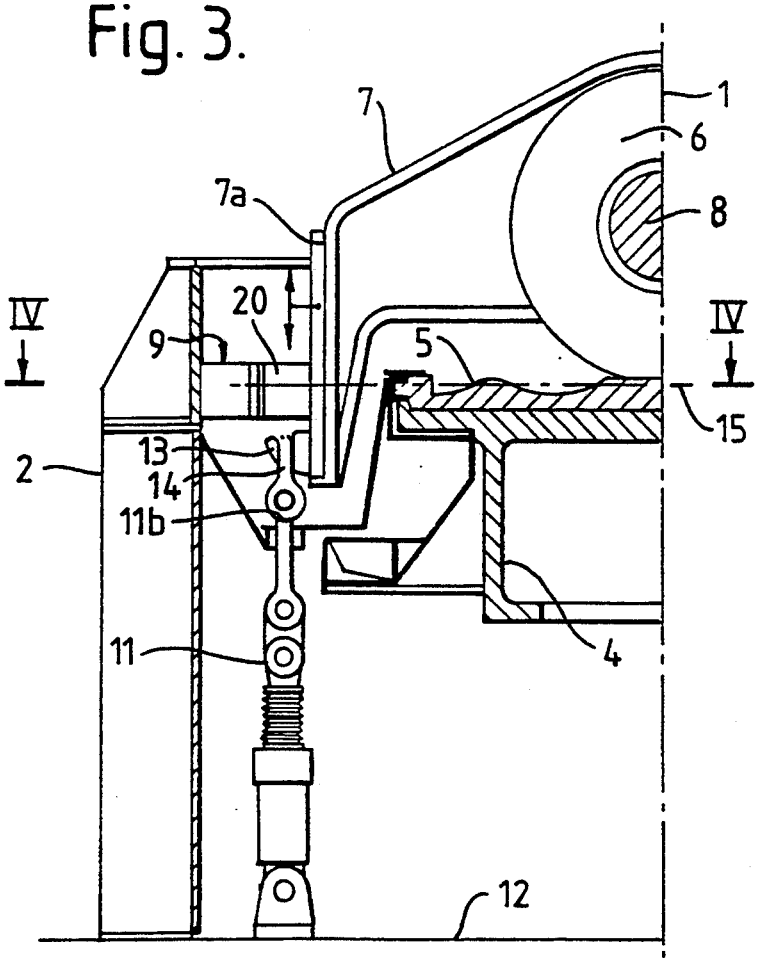
FIG. 3 shows a similar partial sectional view to that of FIG. 1, but of a second embodiment of the roll mill.
Figure 4:
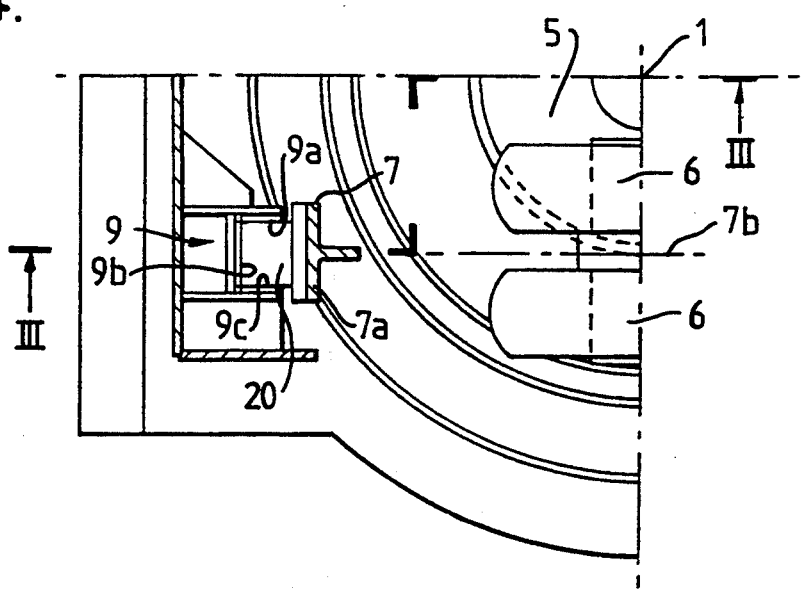
FIG. 4 shows a partial horizontal sectional view according to the line IV—IV in FIG. 3.

The second embodiment of the roller mill illustrated in FIGS. 3 and 4 differs from the first example described (FIGS. 1 and 2) only as regards the vertical guiding and the arrangement of the linkage points on the ends of the roller supports. Since all other parts of the mill can be of similar construction to the first embodiment the same reference numerals as in the first example are used for these similar parts, so that it is largely unnecessary to repeat a detailed description thereof and only some principal parts are provided with the corresponding reference numerals.

In this second embodiment (FIGS. 3 and 4) of the roll mill with a vertical axis the guide lugs can be formed on the outer ends *7a* of the roller support—with respect to the roller support 7 or the horizontal longitudinal central axis *7b* thereof—by cylindrical guide pins 20 which project axially outwards from the roller support 7, whilst housing guides 9 which are adapted thereto are again provided, of which each three have vertically aligned guide surfaces *9a*, *9b* and *9c* which are approximately at right angles to one another and are coordinated so that in horizontal section (FIG. 4) they form a U shape which is open towards the grinding table 4. In this case the clear distance between the two opposing guide surfaces *9a* and *9c* (surfaces of the arms of the U) is adapted to the diameter of the appertaining guide pin 20 so that a reliable lateral, horizontal and radial or axial guide for each end *7a* of a roller support is produced, the guide pins 20 lying on both ends *7a* of a roller support 7 and advantageously coaxially on the longitudinal central axis *7b* of the roller support 7, so that a certain pivotability of the roller support 7 about its longitudinal central axis *7b* is facilitated thereby, which 16 advantageous for the alignment of the grinding rollers 6 in the grinding surface 5 (in adaptation to the particular bed of material for grinding).

In the case of this second embodiment only the housing guides 9 and the guide pins 20 which belong to the ends *7a* of the roller supports and form the guide lugs lie approximately at the height of the horizontal plane 15 of the grinding surface.

By contrast, in this case (FIGS. 3 and 4) the linkage points of the upper ends 11*b* of the tension rods are provided on the outer ends *7a* of the roller supports below the horizontal plane 15 of the grinding surface and at a relatively small and advantageous distance below the corresponding guide pins 20. In a similar manner to the first embodiment, these linkage points can again be formed by shackles 14 articulated on the upper ends 11*b* of the tension rods and by link hooks 13 projecting outwards from the ends *7a* of the roller supports.

In this second embodiment the said linkage points are arranged—unlike the first embodiment—below the plane 15 of the grinding surface, that is to say below the guide lugs or guide pins 20, resulting in a stable equilibrium system in this embodiment.

If the two embodiments of the roll mill according to the invention which are explained with the aid of FIGS. 1 to 4 are compared with the known construction (e.g. DE-B-12 50 724) described in the introduction, then it can be seen that in this known construction not only do the guide bolts lie relatively high above the plane of the grinding surface, but also that the linkage points for the upper ends of the tension rods on the outer ends of the roller supports lie particularly high (above the said guide bolts). As a result, in the known roll mills particularly large tipping movements of the pairs of rollers can be produced about the horizontal longitudinal central axes of the roller supports because inter alia differing feed material bed thicknesses are produced on the grinding track (for example by fluctuating circulations of material for grinding) with the undesirably large frictional forces already mentioned in the introduction. Such continuously changing conditions of the feed material bed and of the frictional forces or moments of friction result—as the tests on which the invention is based have shown—in undesirably large rocking movements (tipping movements about the longitudinal central axis of the roller supports), which leads to undesirably hard and uneven running of the mill (between the grinding rollers and the grinding track). As a result of this interaction of the grinding rollers the theoretical contact point of the grinding rollers on the grinding track changes constantly, i.e. it moves inwards or outwards with each tipping movement of the roller support and thus of the pair of rollers, so that each time a deviation from the theoretically favourable rolling radius is produced. However, each of these deviations represents a braking or acceleration of the grinding roller in question, which adds up to a particularly high energy consumption.

By contrast, in the construction and arrangement according to the invention of the guides and linkage points for the ends of the roller supports, deflection or excessive deflection of the roller supports 7 and thus of the pairs of grinding rollers 6 supported thereon is reliably counteracted, so that—by comparison with the known construction described above—a considerable saving of energy in the grinding process can be achieved. As a result of the said neutral equilibrium system (example according to FIGS. 1 and 2) and also as a result of the stable equilibrium system (example according to FIGS. 3 and 4) the radial vibratory movement between the grinding rollers and the material for grinding can be kept to a minimum in a readily adaptable manner, so that the composition of the feed material bed can be stabilised and thus the grinding efficiency can be increased.

We claim:

1. A roll mill construction comprising a housing; a grinding table supported in said housing for rotation about a vertical axis and having a substantially horizontal grinding surface; at least one roller support extending above and outwardly of said axis beyond said grinding surface; at least one pair of grinding rollers mounted on said roller support at its inner end for rotation about a substantially horizontal axis and in rolling engagement with said grinding surface; a guide lug connected to said roller support and extending beyond the periphery of said grinding table; a vertical guide carried by said housing and cooperating with said guide lug for guiding vertical movements of said roller support; and an upright spring tensioning rod coupled at its upper end to the outer end of said roller support and fixed to a stationary support at its lower end, said guide lug and said vertical guide being positioned at approximately the level of said grinding surface.

2. The construction according to claim 1 wherein the coupling of said tensioning rod to the roller support is approximately at the level of said grinding surface and adjacent the guide lug.

3. The construction according to claim 1 wherein the coupling of said extension rod and the roller support is at a level below that of the grinding surface and the corresponding guide lug.

4. The construction according to claim 1 wherein said guide lug comprises two cylindrical guide pins which project outward from the roller support.

5. The construction according to claim 1 wherein said housing guide has three vertically aligned guide surfaces approximately at right angles to one another and forming a U-shape open toward the grinding table.

6. The construction according to claim 1 wherein said coupling comprises a link hook and a shackle engaged by said hook.

7. The construction according to claim 6 wherein said link hook is attached to the outer end of the roller support for adjustment.

8. The construction according to claim 6 wherein said guide lug comprises a vertical outer face of said link hook and two vertical outer surfaces of the adjacent end of the associated roller support.

9. The construction according to claim 8 wherein the rollers of said pair of rollers are arranged symmetrically on opposite sides of the roller support.

10. The construction according to claim 9 wherein said roller support has an end surface facing outwardly and wherein said link hook is attached to said roller support, and wherein said outer end of said roller support has a coupling attachment located symmetrically on opposite sides of the roller support, said link hook being attachable to a selected one of said attachments.

* * * * *

UNITED STATES PATENT AND TRADEMARK OFFICE

CERTIFICATE OF CORRECTION

PATENT NO. : 5,350,124
DATED : September 27, 1994
INVENTOR(S) : Ludger Lohnherr, et al It is certified that error appears in the above-indentified patent and that said Letters Patent is hereby corrected as shown below:

Column 4, line 55, remove "that".

Column 5, line 29, change "16" to -- is --.

Signed and Sealed this

Twenty-second Day of November, 1994

*Attest:*

Bruce Lehman

BRUCE LEHMAN

*Attesting Officer*

*Commissioner of Patents and Trademarks*